US011401639B2

(12) United States Patent
Wu et al.

(10) Patent No.: US 11,401,639 B2
(45) Date of Patent: Aug. 2, 2022

(54) CORROSION-RESISTANT NON-WOVEN FOR PIPE LINER PULTRUSION APPLICATIONS

(71) Applicant: Owens Corning Intellectual Capital, LLC, Toledo, OH (US)

(72) Inventors: Jianhui Wu, Westerville, OH (US); Kevin Spoo, Newark, OH (US); Jeff Pessell, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 411 days.

(21) Appl. No.: 16/328,835

(22) PCT Filed: Aug. 31, 2017

(86) PCT No.: PCT/US2017/049557
§ 371 (c)(1),
(2) Date: Feb. 27, 2019

(87) PCT Pub. No.: WO2018/128649
PCT Pub. Date: Jul. 12, 2018

(65) Prior Publication Data

US 2019/0242041 A1 Aug. 8, 2019

Related U.S. Application Data

(60) Provisional application No. 62/383,665, filed on Sep. 6, 2016.

(51) Int. Cl.
*D04H 1/587* (2012.01)
*D04H 1/4218* (2012.01)
(Continued)

(52) U.S. Cl.
CPC ..... *D04H 1/587* (2013.01); *D04H 1/4218* (2013.01); *D04H 1/544* (2013.01); *D04H 1/546* (2013.01)

(58) Field of Classification Search
USPC ..... 442/381, 104, 105, 327, 154, 172, 180, 442/401, 408; 428/359, 364, 365, 292.1,
(Continued)

(56) References Cited

U.S. PATENT DOCUMENTS 4,447,570 A 5/1984 Cook et al.
4,735,986 A 4/1988 Iacoviello
(Continued)

FOREIGN PATENT DOCUMENTS

CN 101698783 B 11/2011
CN 103450756 A 12/2013
(Continued)

OTHER PUBLICATIONS

Communication from EP Patent Application No. 17863287.3 dated Jan. 9, 2020.
(Continued)

*Primary Examiner* — Lynda Salvatore
(74) *Attorney, Agent, or Firm* — Calfee, Halter & Griswold LLP

(57) ABSTRACT

A non-woven chopped fiber mat includes a mixture of glass fibers and synthetic fibers. The non-woven mat is formed using a binder composition that includes a binder resin, a coupling agent, and a corrosion inhibitor. The non-woven mat is non-corrosive and resistant to volatile unsaturated monomers such as styrene, but still remains fully compatible with solvent-containing polyester resins, such that it can be used in various pultruded products.

9 Claims, 3 Drawing Sheets

(51) Int. Cl.
*D04H 1/544* (2012.01)
*D04H 1/546* (2012.01)

(58) Field of Classification Search
USPC ..... 428/375
See application file for complete search history.

(56) References Cited

U.S. PATENT DOCUMENTS

| | | | |
|---|---|---|---|
| 5,026,765 | A | 6/1991 | Katz et al. |
| 5,849,389 | A | 12/1998 | Lunsford |
| 6,359,076 | B1 | 3/2002 | Lunsford et al. |
| 6,657,011 | B2 | 12/2003 | Lau et al. |
| 7,348,048 | B2 | 3/2008 | Rabasco et al. |
| 7,485,590 | B2 | 2/2009 | Rabasco et al. |
| 2004/0122166 | A1 | 6/2004 | O'Brien-Bernini et al. |
| 2004/0175407 | A1* | 9/2004 | McDaniel ..... C09D 5/00 424/423 |
| 2005/0287336 | A1 | 12/2005 | Lunsford et al. |
| 2009/0104425 | A1 | 4/2009 | Nandi et al. |
| 2012/0009379 | A1 | 1/2012 | Muller et al. |
| 2013/0202885 | A1 | 8/2013 | Dodge et al. |
| 2013/0209726 | A1 | 8/2013 | Lunsford et al. |
| 2014/0018473 | A1 | 1/2014 | Ratering et al. |
| 2014/0087120 | A1 | 3/2014 | Sagl et al. |
| 2015/0086746 | A1 | 3/2015 | B.R. de Castro et al. |
| 2015/0322279 | A9 | 11/2015 | Lunsford et al. |
| 2016/0185950 | A1 | 6/2016 | Swift |
| 2016/0273140 | A1* | 9/2016 | Wu ..... D21H 17/34 |

FOREIGN PATENT DOCUMENTS

| | | | |
|---|---|---|---|
| CN | 103773288 | A | 5/2014 |
| CN | 102977818 | B | 10/2014 |
| CN | 102994018 | B | 6/2015 |
| DE | 4202071 | A1 | 7/1993 |
| DE | 4228436 | A1 | 3/1994 |
| EP | 1018535 | A1 | 7/2000 |
| EP | 1310537 | B1 | 11/2006 |
| FR | 2246616 | A1 | 5/1975 |
| JP | 2007321036 | A | 12/2007 |
| WO | 1990000967 | A1 | 2/1990 |
| WO | 1990014107 | A1 | 11/1990 |
| WO | 1995034703 | A1 | 12/1995 |
| WO | 2006041848 | A2 | 4/2006 |
| WO | 2009006532 | A1 | 1/2009 |
| WO | 2012118939 | A1 | 9/2012 |
| WO | 2012138723 | A1 | 10/2012 |
| WO | 2013174934 | A1 | 11/2013 |
| WO | 2014165388 | A1 | 10/2014 |
| WO | 2014204779 | A1 | 12/2014 |
| WO | 2015015449 | A1 | 2/2015 |
| WO | 2015057763 | A1 | 4/2015 |
| WO | 2015079317 | A2 | 6/2015 |
| WO | 2015148888 | A1 | 10/2015 |

OTHER PUBLICATIONS

Hana Choi et al.," Encapsulation of triethanolamine as organic corrosion inhibitor into nanoparticles and its active corrosion protection for steel sheets," Surface and Coatings Technology, vol. 206, 2012, pp. 2354-2362.

International Search Report and Written Opinion from PCT/US2017/049557 dated Jun. 14, 2018.

Office Action from CN Patent Application No. 201780059116.4 dated Mar. 8, 2021.

Xu Guanqing et al., "Practical Technology of Automobile Electroplating," p. 228, Beijing Institute of Technology Press, 1st Edition, Feb. 1999.

Office Action from CN Patent Application No. 201780059116.4 dated Jul. 29, 2021.

Office Action from JP Patent Application No. 2019-512780 dated Aug. 10, 2021.

* cited by examiner

CORROSION-RESISTANT NON-WOVEN FOR PIPE LINER PULTRUSION APPLICATIONS

RELATED APPLICATIONS

This application is the U.S. national stage entry of PCT/US2017/049557, filed on Aug. 31, 2017, which claims priority to and all benefit of U.S. Provisional Patent Application No. 62/383,665, filed on Sep. 6, 2016, the entire disclosures of which are fully incorporated herein by reference.

BACKGROUND

Conventional non-woven mats include a fibrous web bound together by a suitable resinous binder. Reinforcement fibers, including natural and man-made fibers, are useful in a variety of technologies, and may be used in the form of continuous or chopped filaments, strands, rovings, woven fabrics, non-woven fabrics, meshes, and scrims, such as to reinforce polymer materials. Reinforced polymeric composites can be formed in a variety of ways from a polymeric matrix material, reinforcing material, and any other components. Such composites are formed using reinforcement fibers which provide dimensional stability and excellent mechanical properties to the resulting composites.

For example, glass fibers provide dimensional stability, as they generally do not shrink or stretch in response to changes in atmospheric conditions. Further, glass fibers have high tensile strength, heat resistance, moisture resistance, and high thermal conductivity.

Non-woven fiber mats are commonly used in pultrusion processes to form various pultruded parts including rods, gratings, pipes, and tubes. Pultrusion is a continuous process for the manufacture of lightweight lineal profile products having a constant cross section. Generally, pultrusion involves impregnating fiber mats with a suitable resin material and pulling the impregnated mat through a heated dye with a continuous pulling device. By passing the impregnated and consolidated mat through the heated dye, the resin is cured, resulting in a hardened mat that may be formed into a desired shape. As the composite exits the heated dye, it is cooled and cut to a desired length.

The continuous nature of the pultrusion process advantageously enables composites of any desired length or thickness to be produced. The pultrusion process also produces products with high fiber loading profiles, which give the products enhanced structural properties (e.g., high specific strength/stiffness to weight ratio). However, there are problems associated with the pultrusion process. One problem involves the resin bath generally used to impregnate the fiber mat. Thermoset resins are typically used, which generally require the use of volatile unsaturated monomers, such as styrene and/or methyl methacrylate. Styrene is a potent solvent that can easily swell and degrade a binder applied to the reinforcement mat. Such degradation of the binder can cause the fiber mat to weaken, rendering it unable to withstand the strong pulling forces used during the pultrusion process.

Another problem with the pultrusion process involves the metal surfaces used in the manufacturing process. When the metal surfaces are exposed to the binder during manufacturing, corrosive agents (i.e., compounds/chemicals that cause corrosion) in the binder are often transferred onto the metal, which can eventually cause corrosion of the metal itself. Corrosion is a process by which a refined metal is converted to a more stable form (oxide, hydroxide, sulfide, etc.) through a chemical reaction with the surrounding environment. This chemical reaction degrades the metal and causes weakening or, in some cases, cracking/shattering of the metal.

Therefore, a need exists for a non-woven mat that is non-corrosive and resistant to volatile unsaturated monomers such as styrene, but still remains fully compatible with solvent-containing polyester resins, such that it can be used satisfactorily in downstream processing, including various pultrusion applications.

SUMMARY

According to some exemplary embodiments, a non-woven mat comprising a non-corrosive binder composition is provided. The non-woven mat comprises a plurality of reinforcing fibers in addition to the binder composition. The binder composition comprises a binder resin, a coupling agent, and a corrosion inhibitor. The binder resin comprises a thermoset material, a thermoplastic material, or a combination thereof. The non-woven mat exhibits a tensile strength of at least 1.0 lbs/ft after being soaked in a 100% styrene monomer for 10 minutes.

In some exemplary embodiments, the plurality of reinforcing fibers can be selected from the group consisting of glass fibers, synthetic fibers, natural fibers, and combinations thereof. In some exemplary embodiments, the plurality of reinforcing fibers is glass fibers and in other exemplary embodiments, is a mixture of chopped glass fibers and synthetic fibers.

In some exemplary embodiments, the non-woven mat comprises from 10.0 to 100 wt. % of the chopped glass fibers and from 0 to 90.0 wt. % of the synthetic fibers.

In some exemplary embodiments, the corrosion inhibitor is an organic corrosion inhibitor, including triethanolamine, which can be present in the binder composition from 0.05 to 15.0 wt. %, based on the total solids in the binder composition.

In some exemplary embodiments, the binder composition further comprises a defoamer, which can be present in an amount from 0.01 to 10.0 wt. %, based on the total solids in the binder composition.

In some exemplary embodiments, the coupling agent of the binder composition comprises a silane coupling agent, which can be present in an amount from 0.05 to 10.0 wt. %, based on the total solids in the binder composition.

In some exemplary embodiments, the thermoset material can be at least one of an acrylic material and a urea formaldehyde material. In some embodiments, the acrylic material is polyacrylic acid, which can be a low molecular weight polyacrylic acid with a molecular weight at or below 10,000. The thermoplastic material can be ethylene vinyl acetate.

In some exemplary embodiments, the binder resin comprises from 50.0 to 100 wt. % or from 70.0 to 85.0 wt. % of the thermoplastic material and from 0 to 50.0 wt. % or from 15.0 to 30.0 wt. % of the thermoset material, based on the total binder resin.

In some exemplary embodiments, the non-woven mat exhibits an increase of at least 12% or of at least 93% in tensile strength after being soaked in the 100% styrene monomer for 10 minutes, as compared to an otherwise identical non-woven mat without the corrosion inhibitor.

In some exemplary embodiments, the non-woven mat exhibits a tensile strength of at least 2.5 lbs/ft or of at least 3.0 lbs/ft after being soaked in the 100% styrene monomer for 10 minutes.

In some exemplary embodiments, the non-woven mat does not exhibit any fiber whitening after curing, as compared to an otherwise identical non-woven mat without the corrosion inhibitor.

In some exemplary embodiments, the binder composition exhibits a pH of at least 3.69, after formation in the liquid state.

In some exemplary embodiments, a pultruded composite product is provided which comprises at least one roving impregnated with a thermoset resin and a non-woven mat that comprises a plurality of reinforcing fibers and a binder composition which comprises a binder resin, a coupling agent, and a corrosion inhibitor. The binder resin comprises a thermoset material, a thermoplastic material, or a combination thereof. The non-woven mat exhibits a tensile strength of at least 1.0 lbs/ft after being soaked in the 100% styrene monomer for 10 minutes.

In some exemplary embodiments, the plurality of reinforcing fibers can be selected from the group consisting of glass fibers, synthetic fibers, natural fibers, and combinations thereof. In some exemplary embodiments, the plurality of reinforcing fibers is glass fibers and in other exemplary embodiments, is a mixture of chopped glass fibers and synthetic fibers.

In some exemplary embodiments, the non-woven mat of the pultruded composite product comprises from 10.0 to 100 wt. % of the chopped glass fibers and 0 to 90.0 wt. % of the synthetic fibers.

In some exemplary embodiments, the corrosion inhibitor is an organic corrosion inhibitor, including triethanolamine, which can be present in the binder composition from 0.05 to 15.0 wt. %, based on the total solids in the binder composition.

In some exemplary embodiments, the binder composition further comprises a defoamer, which can be present in an amount from 0.01 to 10.0 wt. %, based on the total solids in the binder composition.

In some exemplary embodiments, the coupling agent of the binder composition comprises a silane coupling agent, which can be present in an amount from 0.05 to 10.0 wt. %, based on the total binder composition.

In some exemplary embodiments, the thermoset material can be at least one of an acrylic material and a urea formaldehyde material. In some embodiments, the acrylic material is polyacrylic acid, which can be a low molecular weight polyacrylic acid with a molecular weight at or below 10,000. The thermoplastic material can be ethylene vinyl acetate.

In some exemplary embodiments, the binder resin comprises from 50.0 to 100 wt. % or from 70.0 to 85.0 wt. % of the thermoplastic material and from 0 to 50.0 wt. % or from 15.0 to 30.0 wt. % of the thermoset material, based on the total binder resin.

In some exemplary embodiments, the non-woven mat of the pultruded composite product exhibits an increase of at least 12% or of at least 93% in tensile strength after being soaked in the 100% styrene monomer for 10 minutes, as compared to an otherwise identical non-woven mat without the corrosion inhibitor.

In some exemplary embodiments, the non-woven mat of the pultruded composite product exhibits a tensile strength of at least 2.5 lbs/ft or of at least 3.0 lbs/ft after being soaked in the 100% styrene monomer for 10 minutes In some exemplary embodiments, the non-woven mat of the pultruded composite product does not exhibit any fiber whitening after curing, as compared to an otherwise identical non-woven mat without the corrosion inhibitor.

In some exemplary embodiments, the binder composition of the pultruded composite product exhibits a pH of at least 3.69, after formation in the liquid state.

DETAILED DESCRIPTION

Figure 1:
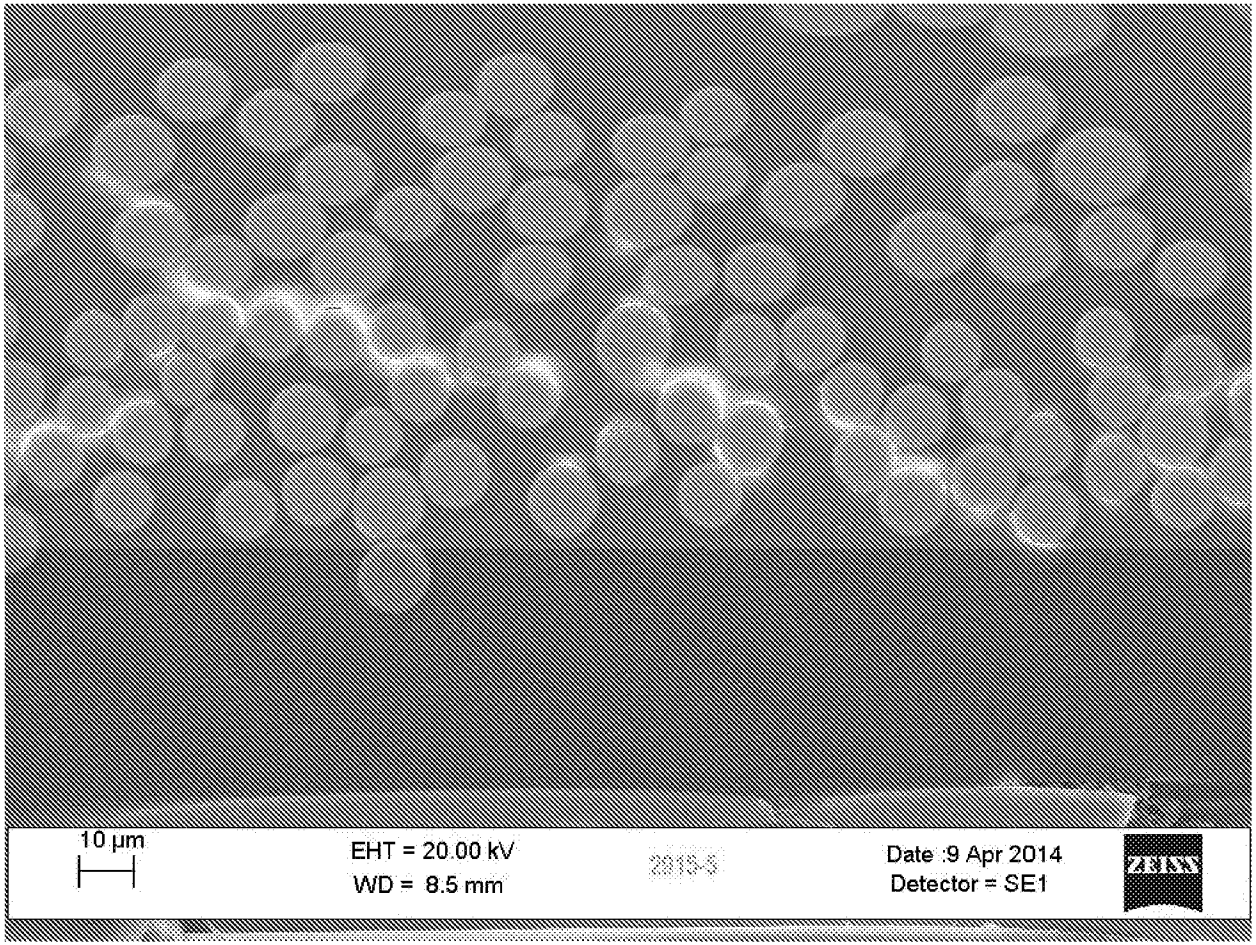
FIG. 1 is a pictorial representation of dis-bonds that occur in the interface between resin and glass.
Figure 2:
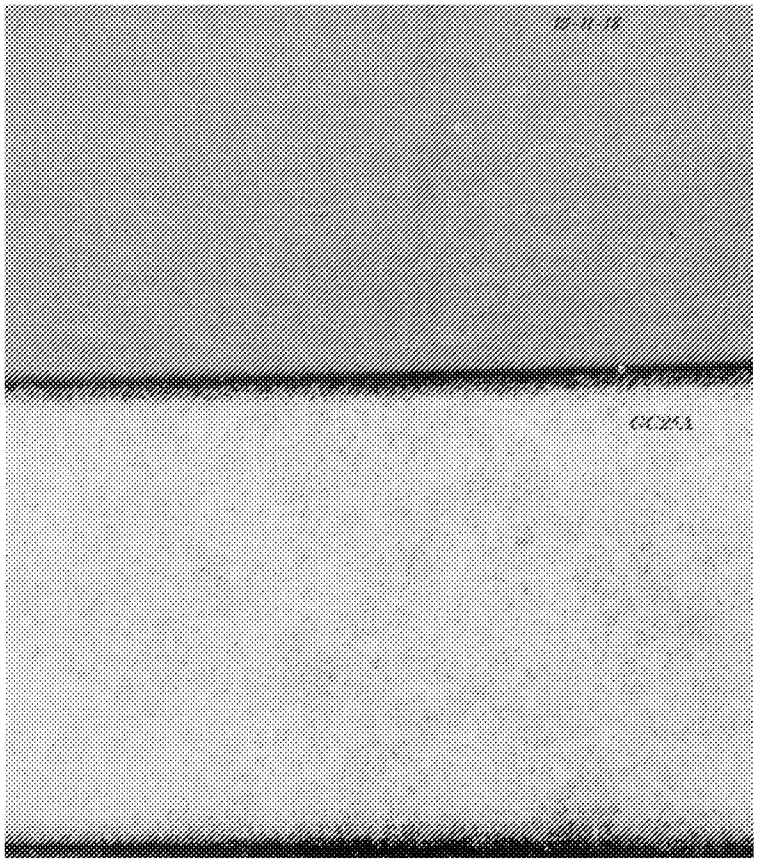
FIG. 2 is a pictorial representation of the difference between a glass mat that has experienced de-bonding/whitening (bottom) and a glass mat that has not experienced de-bonding/whitening (top).

While various exemplary embodiments are described or suggested herein, other exemplary embodiments utilizing a variety of methods and materials similar or equivalent to those described or suggested herein are encompassed by the general inventive concepts.

Unless defined otherwise, all technical and scientific terms used herein have the same meaning as commonly understood by one of ordinary skill in the art to which the invention belongs. In connection, unless otherwise indicated, concentrations of ingredients given in this document refer to the concentrations of these ingredients in the master batch or concentrate, in keeping with customary practice.

The terminology as set forth herein is for description of the exemplary embodiments only and should not be construed as limiting the application as a whole. Unless otherwise specified, "a," "an," "the," and "at least one" are used interchangeably. Furthermore, as used in the description of the application and the appended claims, the singular forms "a," "an," and "the" are inclusive of their plural forms, unless contradicted by the context surrounding such.

The general inventive concepts relate to a flexible non-woven mat with improved properties. In some exemplary embodiments, the flexible non-woven mat demonstrates resistance to corrosive agents, reduced acidity, and better cure efficiency, while still remaining fully compatible with solvent-containing polyester resins. In various exemplary embodiments, the flexible non-woven mat substantially reduces or eliminates glass fiber debonding, which plagues traditional mats and leads to a shortened lifespan of pipes lined with the mats. Additionally, in accordance with various exemplary embodiments, the inventive flexible non-woven mats are resistant to volatile unsaturated monomers such as styrene as well as polyester resins that may be present in resin formulations utilized in pultrusion processes. The improved chemical properties of the flexible non-woven mats result in improved downstream processes, for example, the formation of pultruded products having complex shapes and sizes. The flexible non-woven mats of the present invention may comprise a plurality of fibers, including any of natural fibers, man-made fibers, or a combination thereof.

The term "natural fiber" as used in conjunction with the present invention refers to a non-man-made fiber having suitable reinforcing characteristics. Natural fibers can include plant fibers extracted from any part of a plant, including, but not limited to, the stem, seeds, leaves, roots, or phloem as well as animal fibers, including, but not limited to, silk and wool. Natural fibers can also include mineral fibers, including, but not limited to, asbestos, attapulgite, sepiolite, rutile, and pyrite. Examples of natural fibers which may be suitable for use as the reinforcing fiber material include, but are not limited to, basalt, cotton, jute, bamboo, ramie, bagasse, hemp, coir, linen, kenaf, sisal, flax, henequen, and combinations thereof.

The term "man-made fiber" as used in conjunction with the present invention refers to any fiber whose chemical composition or structure is modified. Man-made fibers can include both organic fibers and inorganic fibers. Inorganic fibers can include, for example, glass fibers, carbon fibers, other metallic fibers, or specialty fibers. Organic fibers can include both natural polymer fibers and synthetic polymer fibers.

In some exemplary embodiments, the fibers include glass fibers. The glass fibers can be made from any type of glass. Examples of glass fibers include: A-type glass fibers, C-type glass fibers, E-type glass fibers, S-type glass fibers, ECR-type glass fibers (e.g., Advantex® glass fibers commercially available from Owens Corning), Hiper-Tex™, wool glass fibers, and combinations thereof. The use of other reinforcing fibers, such as mineral fibers, carbon fibers, ceramic fibers, natural fibers, and/or synthetic fibers in the non-woven mat is also considered to be within the purview of the general inventive concepts. The term "synthetic fibers" or "synthetic polymer fibers" as used herein is meant to indicate any man-made fiber having suitable reinforcing characteristics, such as polyester, polyethylene, polyethylene terephthalate, polypropylene, polyamide, aramid, polyaramid fibers, and combinations thereof.

In some exemplary embodiments, the fibers used to form the non-woven mats according to the present invention include a combination of glass fibers and synthetic resin fibers, such as polymer fibers. In accordance with various exemplary embodiments, the polymer fibers include those made from polypropylene, polyethylene terephthalte (PET), or a combination thereof.

In some exemplary embodiments, the fibers used to form the non-woven mats according to the present invention include about 10.0 to about 100 wt. % glass fibers and about 0 to about 90.0 wt. % polymer fibers. In other exemplary embodiments, the fibers include about 50.0 to about 90.0 wt. % glass fibers and about 10.0 to about 50.0 wt. % polymer fibers, or from about 75.0 to about 90.0 wt. % glass fibers and about 10.0 to 25.0 wt. % polymer fibers. In other exemplary embodiments, the non-woven mat includes 100 wt. % glass fibers or 100 wt. % polymer fibers. The polymer fibers can be synthetic polymer fibers. As used herein, unless the context indicates otherwise, the phrase "percent by weight of the composition" and "wt. %" are meant to denote percent by weight of the total components of the composition.

The glass fibers may be formed by conventional methods known to those skilled in the art. For example, the glass fibers may be formed by a continuous manufacturing process in which molten glass passes through the orifices or tips of a bushing, the streams of molten glass thereby formed are solidified into filaments, and the filaments are combined together to form a fiber, roving, strand, or the like.

The flexible non-woven mat may be formed by a variety of processes, including dry-laid and wet-laid processes. In some exemplary embodiments, the non-woven mat is formed by a wet-laid process, which involves forming an aqueous dispersion in a mix tank filled with various components such as water, surfactants, viscosity modifiers, defoaming agents, lubricants, biocides, and/or other chemical agents (sometimes collectively referred to as "white water"). Fibers are then introduced into the slurry/white water solution and agitated such that the fibers become dispersed. It is desirable that the slurry is sufficiently agitated to provide a uniform or nearly uniform dispersion of the fibers therein.

The aqueous fiber dispersion may then be processed into a wet-laid mat according to conventional methods known in the art. For example, the aqueous fiber dispersion is deposited onto a moving screen or conveyor, on which the majority of the water drains through, leaving a randomly oriented fiber web. The fiber web may be further dried by a vacuum oven or other drying means.

A binder composition may then be applied to the fiber web in any conventional manner, such as by curtain coating, spraying, a twin wire dip bath, a two roll padder, and the like. Water, excess binder, and excess coupling agent may then be removed by a vacuum or other water removal means. Finally, the binder-coated fiber product may be dried and cured in one or more ovens. An exemplary temperature range for drying is from about 425° F. (218° C.) to about 525° F. (274° C.). An exemplary time spent in the oven is between 0.1 and 3 minutes. The dried and cured product is the finished non-woven flexible mat.

As described herein, the non-woven mat can also be produced by a dry-laid process. In this process, fibers are chopped and air blown onto a conveyor and a binder is then applied to form the mat. Typically, the fibers are deposited onto the conveyor in a randomly oriented manner. The binder-coated fiber product may be dried and cured in one or more ovens.

In some exemplary embodiments, the binder composition comprises a binder resin material, a coupling agent, and one or more optional additives. The binder resin may be a thermoset material, a thermoplastic material, or a mixture of thermoset and thermoplastic materials. The thermoset material may comprise, for example, an acrylic material, a urea formaldehyde material, or a combination of the two materials. In some exemplary embodiments, the acrylic material is polyacrylic acid, such as low molecular weight polyacrylic acid with a molecular weight at or below 10,000. In some exemplary embodiments, the low molecular weight polyacrylic acid has a molecular weight from 100 to 10,000. In other exemplary embodiments, the low molecular weight polyacrylic acid has a molecular weight from 2,000 to 6,000. In some exemplary embodiments, the polyacrylic acrylic acid composition comprises QR-1629S, a polyacrylic acid/glycerin mixture, commercially available from Rohm and Haas (now Dow Chemical) of Philadelphia, Pa. The thermoset material, once cross-linked under proper curing conditions, provides good tensile performance and solvent resistance, helping maintain mat integrity in different applications.

In some exemplary embodiments, the thermoplastic material may include any thermoplastic material having a low glass transition temperature (Tg) (i.e., below about negative 15° C. (−15° C.)). The glass transition temperature is the temperature range at which the polymer material transitions from a hard, glass-like material into a soft, rubbery material. The thermoplastic material can be, for example, ethylene vinyl acetate ("EVA"). Other suitable thermoplastic materials include polyvinylidene fluoride, polypropylene, polyethylene, and polyvinyl fluoride. In some exemplary embodiments, the EVA comprises Dur-O-Set® E-646, commercially available from Celanese Corp. of Florence, Ky. The thermoplastic material is self cross-linking and can provide the softness needed for flexible mats.

It has been discovered that formulating a binder composition that incorporates resins with differing functionalities (e.g., thermoset and thermoplastic) may impart improved properties to a chopped fiber reinforced mat. In particular, the combination of such properties may allow the non-woven mats to be used in challenging applications, such as in pultrusion applications, as a replacement for continuous filament mats. Some exemplary binder compositions include about 0 to about 50.0 wt. % thermoset material, such as polyacrylic acid, and about 50.0 to about 100 wt. % thermoplastic material, such as EVA. In other exemplary embodiments, the binder resin comprises about 15.0 to about 30.0 wt. % thermoset material and about 70.0 to about 85.0 wt. % thermoplastic material. In still other exemplary embodiments, the binder resin comprises about 17.0 to about 25.0 wt. % thermoset material and about 72.0 to about 80.0 wt. % thermoplastic material.

In some exemplary embodiments, the binder resin may be present in the binder composition in an amount from about 80.0 to about 99.0 wt. %, based on the total solids in the binder composition, in some exemplary embodiments, from about 90.0 to about 99.0 wt. %, based on the total solids in the binder composition, and in other exemplary embodiments, from about 97.0 to about 99.0 wt. %, based on the total solids in the binder composition.

The binder composition may further include a coupling agent. It is to be appreciated that the coupling agents described herein are exemplary in nature, and any suitable coupling agent known to those of ordinary skill in the art may be utilized in any of the exemplary embodiments described or otherwise suggested herein. The amount of coupling agent or combination of coupling agents can vary based on the specific compound(s) used as well as the other compounds used in the binder and can generally be added in any suitable amount known to those skilled in the art. In some exemplary embodiments, the coupling agent, or coupling agents, may be present in the binder composition in an amount from about 0.05 to about 10.0 wt. %, based on the total solids in the binder composition, and in other exemplary embodiments, in an amount from about 0.1 to about 3.0 wt. %, based on the total solids in the binder composition. Various exemplary embodiments include about 0.2 to about 0.5 wt. % of the coupling agent, based on the total solids in the binder composition. Besides their role of improving the coupling between the surface of the reinforcement fibers and the surrounding matrix, the coupling agents can also function to reduce the level of fuzz, or broken fiber filaments, during subsequent processing.

In some exemplary embodiments, at least one of the coupling agents is a silane coupling agent. Silane coupling agents are coupling agents that contain silicon-based chemicals. Suitable silane coupling agents may include silanes containing one or more nitrogen atoms that have one or more functional groups such as amine (primary, secondary, tertiary, and quaternary), amino, imino, amido, imido, ureido, or isocyanato. In one exemplary embodiment, the silane is a methoxy silane. Methoxy silanes are particularly useful because they exhibit methacryloxy functionality. Methoxy functionality provides good adhesivion between the binder and glass surface and also improves wet-ability of polyester resin on glass non-wovens which limits glass debonding. Suitable silane coupling agents may also include, but are not limited to, aminosilanes, silane esters, vinyl silanes, methacryloxy silanes, epoxy silanes, sulfur silanes, ureido silanes, methoxy silanes, and isocyanato silanes. Specific, non-limiting examples of silane coupling agents for use in the instant invention include γ-methacryloxypropyltrimethoxysilane (A-174), γ-aminopropyltriethoxysilane (A-1100), n-phenyl-γ-aminopropyltrimethoxysilane (Y-9669), n-trimethoxy-silyl-propyl-ethylene-diamine (A-1120), methyl-trichlorosilane (A-154), γ-chloropropyltrimethoxy-silane (A-143), vinyl-triacetoxysilane (A-188), and methyltrimethoxysilane (A-1630). All of the silane coupling agents identified above, with the exception of methacrlyoxypropyl silane (Z-6030 commercially available from Dow Corning of Midland, Mich.), are commercially available from Momentive Performance Materials Inc. of Strongsville, Ohio.

In some exemplary embodiments, the binder composition further comprises a corrosion inhibitor. A corrosion inhibitor is a chemical compound which decreases the corrosion rate of a base material. In this way, corrosion inhibitors prevent corrosive agents from penetrating the base material and causing corrosion.

The corrosion inhibitor of the current invention can be either an inorganic or organic corrosion inhibitor. If the corrosion inhibitor is chosen from an inorganic compound, the corrosion inhibitor can be either anodic (passivation inhibitor) or cathodic. Anodic corrosion inhibitors block anode reactions by forming an insoluble film on the base material. Cathodic corrosion inhibitors block cathodic reactions by either slowing the cathode reaction itself or by selective precipitation on cathodic areas, which limits the diffusion of reducing species on the surface. Some corrosion inhibitors can even contain both cathodic and anodic inhibitors (mixed inhibitors). These mixed inhibitors work by blocking both anodic and cathodic sites on the surface indirectly. Organic corrosion inhibitors generally work through surface adsorption or film-forming. These compounds build up a protective hydrophobic film on the surface of the base material.

In general, the type of corrosion inhibitor employed is chosen based on a number of factors including, but not limited to, the type of metal in the base material and the temperature ranges they have to operate in. Non-limiting examples of corrosion inhibitors include, hexamine, alkanolaminesphynylenediamine, dimehylethanolamine, sodium nitrite, cinnamaldehyde, chromates, nitriles, silicates, phosphates, hydrazine, zinc oxide, benzalkonium chloride, and ascorbic acid. In some exemplary embodiments, the corrosion inhibitor comprises an alkanolamine, such as triethanolamine ("TEA").

In addition to its ability to inhibit corrosion on various metals, TEA exhibits other properties that make it particularly advantageous. TEA can complex with acidic functional groups to reduce acidity. For example, binders use to bind non-wovens without alkanolamine corrosion-inhibitors such as TEA may exhibit a pH of about 2.5. Non-wovens, however, which comprise an alkanolamine corrosion-inhibitor such as TEA, can exhibit pHs of closer to 4.5. This is particularly important because highly acidic binders can cause processing issues in the plants which produce the non-wovens, leading to corrosion of non-stainless steel based equipment. Additionally, TEA can act as a crosslinking agent, able to crosslink with the polyacrylic acid, by virtue of its three hydroxyl groups. This can lead to better cure efficiency.

The amount of corrosion inhibitor can vary based on the specific compound used as well as the other compounds used in the binder. In some exemplary embodiments, the corrosion inhibitor may be present in the binder composition in an amount from about 0.05 to about 15.0 wt. %, based on the total solids in the binder composition, and in other exemplary embodiments, in an amount from about 0.1 to about 5.0 wt. %, based on the total solids in the binder composition. In other exemplary embodiments, the corrosion inhibitor may be present in an amount from about 0.5 to about 3.5 wt. %, based on the total solids in the binder composition. Various exemplary embodiments include about 1.5 to about 2.5 wt. %, based on the total solids in the binder composition, of a corrosion inhibitor.

The binder composition may further comprise a defoamer. A defoamer or anti-foaming agent is a chemical that reduces or hinders the formation of foam in process liquids. The formation of foam in an industrial process can be particularly problematic. For example, foam can cause defects on surface coating, can prevent efficient filling, can increase volume during processing causing overflowing, and can reduce the process speed and availability of equipment used to process the final product. The extent of foaming in binders is influenced by a number of factors including: ingredients in the binder, production methods, and application methods.

It is to be appreciated that the defoamers described herein are exemplary in nature, and any suitable defoamer known to those of ordinary skill in the art may be utilized in any of the exemplary embodiments described or otherwise suggested herein. It is envisioned that any of the common classes of defoamers can be employed in the present invention including oil based defoamers, powder defoamers, water based defoamers, silicone based defoamers, alkyl polyacrylates, and EO/PO (ethylene oxide and propylene oxide) based defoamers. Exemplary defoamers include Drew Plus Y-250 available from Drews Industrial Division of Boonton, N.J., Vinamul 7700 from Celanese Corp. of Irving, Tex., and those defoamers sold under the trade name TERGITOL™ from The Dow Chemical Company of Midland, Mich.

The amount of defoamer can vary based on the specific compound used as well as other compounds used in the binder composition. In some exemplary embodiments, the defoamer may be present in the binder composition in an amount from about 0.01 to about 10.0 wt. %, based on the total solids in the binder composition, and in other exemplary embodiments, in an amount from about 0.05 to about 5.0 wt. %, based on the total solids in the binder composition. In other exemplary embodiments, the defoamer may be present in an amount from about 0.1 to about 1.0 wt. %, based on the total solids in the binder composition. Various exemplary embodiments include about 0.2 to about 0.5 wt. %, based on the total solids in the binder composition of a defoaming agent.

The binder composition may optionally include additional components, for example, dyes, oils, fillers, colorants, aqueous dispersions, UV stabilizers, lubricants, wetting agents, surfactants, viscosity modifiers, and/or antistatic agents. The aqueous dispersions may include antioxidant dispersions, which counter the effects of oxidation by the binder composition due to aging. One exemplary antioxidant dispersion includes Bostex 537 from Akron Dispersions, Inc of Akron, Ohio. The antioxidant dispersion may be included in amounts from about 0 to about 5.0 wt. %, based on the total solids in the binder composition, or from about 0.5 to about 3.0 wt. %, based on the total binder composition solids. Some exemplary embodiments include about 1.0 to about 2.0 wt. %, based on the total solids in the binder composition of an antioxidant dispersion. Additives may be included in the binder composition in an amount of about 0 to about 10.0 wt. %, based on the total solids in the binder composition.

In accordance with some exemplary embodiments, the binder composition further includes water to dissolve or disperse the components for application onto the reinforcement fibers. Water may be added in any amount sufficient to dilute the aqueous binder composition to a viscosity that is suitable for its application to the reinforcement fibers. For example, the binder composition may contain from about 50.0 to about 75.0 wt. % of water, based on the total binder composition.

In some exemplary embodiments, the binder composition in the liquid state after formation exhibits a pH in the range of about 1.0 to about 7.0, or in the range of about 2.0 to about 6.0, or in the range of about 2.5 to about 5.0, or in the range of about 3.0 to about 4.5.

As discussed herein, the binder composition provides improved resistance to volatile unsaturated monomers such as styrene monomers commonly found in thermosetting resins used in pultrusion processes. This enhanced resistance to styrene makes the flexible non-woven mats more suitable for pultrusion processes. As discussed herein, styrene monomers are a potent solvent and can act to swell and degrade the binder, thereby weakening the continuity of the mat. By providing a flexible non-woven mat resistant to styrene monomers, the flexible non-woven mat, and thus the resulting pultruded part incorporating the same, maintains tensile strength in the longitudinal direction as well as in the transverse direction.

As discussed herein, the binder composition is also non-corrosive. The corrosion of copper pipes commonly used in home plumbing is extremely common and can be caused by water that is too acidic (low pH) or too basic (alkaline, high pH), sand or other sediment in the water, and other chemical causes including high levels of oxygen, high levels of dissolved salts, and corrosion-causing bacteria. Pipe corrosion raises serious health concerns including the absorption of lead, copper, and other harmful chemicals/metals from the pipe into the drinking water supply. As discussed herein, the inventive binder composition includes a corrosion inhibitor, such as an alkanolamine such as TEA. Consequently, pipes or pipe-liners formed therefrom resist chemical corrosion, thereby alleviating these health concerns. Corrosion inhibitors, such as TEA displace water molecules on the metal or other surface and form a hydrophobic film which protects the metal or other surface against corrosion. Unlike other corrosion inhibitors which often contain harsh chemicals, TEA is relatively Environmental Health and Safety friendly. Indeed, TEA is frequently used in various cosmetic and topical compositions.

As discussed herein, the glass mat with the inventive binder composition also shows good compatibility with solvent-containing polyester resins. In contrast with other commercial glass mats and binders, the glass mat with the inventive binder composition did not show any whitening or glass de-bonding in the mat. Such whitening/de-bonding is easily observable with the naked eye and does not require any magnification. This type of fiber whitening occurs as a result of stresses created in the resin system during the resin system cure and shrinkage. Volumetric shrinkage can be up to 8.0% while the exotherm during cure exacerbates the difference in the coefficient of thermal expansion between the resin and glass. As the system shrinks, the bond between the resin and resin is stronger than between glass fiber and resin. As a result, when stresses exceed the bond strength between resin and glass, the interface dis-bonds. This dis-bond is a gap which allows for the rapid transport of corrosive fluids through the corrosion layer, which is intended to be a barrier to the passage of corrosive fluids. As the fiber and resin dis-bond, light scattering off this dis-bond area is reflected and appears white. This whitening can be seen in FIG. 1.

In some exemplary embodiments, the non-woven mat with a binder composition that contains a corrosion inhibitor exhibits tensile strengths after being soaked in 100% styrene monomer for 10 minutes that are at least 12% or at least 93% or at least 235% higher than an otherwise identical non-woven mat without the corrosion inhibitor. In some exemplary embodiments, the non-woven mat with a binder composition that contains a corrosion inhibitor exhibits tensile strengths of at least 1.0 pound per foot (lb/ft), or of at least 2.5 lbs/ft, or of at least 3.0 lbs/ft after being soaked in 100% styrene monomer for 10 minutes. Styrene is present in many pultrusion applications and thus a non-woven mat that is resistant (i.e., maintain good tensile strength even after exposure to styrene) to styrene is much more suitable for such pultrusion applications.

In some exemplary embodiments, the non-woven mat with a binder composition that contains at least 4.0 wt. % of a corrosion inhibitor exhibits a pH of at least 3.69, or of at least 4.00, or of at least 4.2, after formation in the liquid state.

Having generally introduced the general inventive concepts by disclosing various exemplary embodiments thereof, a further understanding can be obtained by reference to certain specific examples illustrated below which are provided for purposes of illustration only and are not intended to be all inclusive or otherwise limiting of the general inventive concepts.

WORKING EXAMPLE

The following example is included for purposes of illustration and is not intended to limit the scope of the methods described herein.

Example 1

The binder formulation (Composition A) was prepared according to the composition listed in Table 1. Commercially available GC25A and GC30A mats were used for comparison. The GC25A and GC30A mats are acrylic based and do not contain a corrosion inhibitor.

TABLE 1

| Material | Chemistry | Dry Fraction |
|---|---|---|
| QR1629S | PAA | 0.2200 |
| DUR-O-SET E646 | VAE | 0.7555 |
| TEA | Triethanolamine | 0.0200 |
| A-174 | Silane | 0.0020 |
| FC414 | Defoamer | 0.0025 |

A panel containing Composition A and the commercially available binders, GC25A and GC30A, was laminated using the same resin and identical curing conditions. A pool of resin was poured out and the veils in the resin were wetted. The resin was not rolled out, but simply wicked toward the outer edges of the panel. Each of the three plies was fully wetted in the de-aerated resin. After adding the last ply, a Mylar sheet was placed on top of the laminate trapping air bubbles between the Mylar and the laminate. These air bubbles were squeezed out with a tongue depressor.

Figure 3:
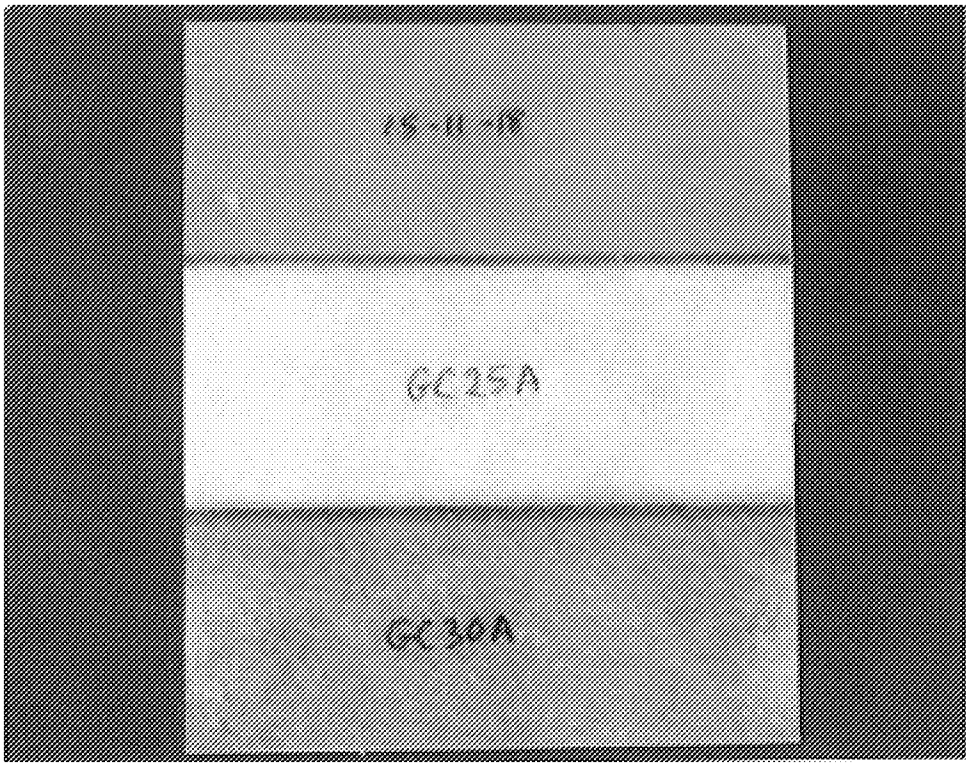
FIG. 3 shows cured binder formulations of the present invention compared to commercially available samples.

A glass plate was then placed on top of the laminate, which slowly forced the resin toward the outer edges of the panel. A weight was subsequently placed on the glass plate to achieve a uniform resin thickness of 3.0 mm. To speed up the resin gel time, a heating pad was placed under the panel. Once the resin was hard enough to remove the panel, the resins were placed in the oven at 80° C. After curing, significant and distinct de-bonding/whitening was observed in the acrylic-based GC25A and GC30A commercially available samples, while the binder formulation according to Table 1 exhibited no such de-bonding/whitening. The whitening was easily observable with the naked eye and did not require any magnification. The results can be seen in FIG. 3.

Styrene resistance test were also performed on the inventive binder formulation and the commercially available mats. To test the binder's ability to function after exposure to styrene, the binder was soaked in styrene and subsequently tested to determine its measured tensile strength. 10 loads were tested. Tensile properties indicate how a specific material reacts when tension forces are applied to it. GC25A and Composition A were each soaked in 100% styrene monomer bath for 10 minutes. After soaking, tensile strength tests were performed on each mat, using an Instron machine. To test the tensile strength, each mat was elongated by a pulling apparatus and the force required to break each mat was recorded. Each mat was tested at 2.0 in/min. The results are shown in Table 2.

TABLE 2

| Load | Composition A tensile strength (lbs/ft) | GC25A tensile strength (lbs/ft) |
|---|---|---|
| Mean | 2.08 | 0.62 |
| Standard Deviation | 1.35 | 0.17 |
| Control Value | 64.78 | 27.40 |
| Load 1 | 1.09 | 0.73 |
| Load 2 | 1.56 | 0.81 |
| Load 3 | 4.92 | 0.54 |
| Load 4 | 3.51 | 0.68 |
| Load 5 | 2.25 | 0.36 |
| Load 6 | 1.08 | 0.87 |
| Load 7 | 2.98 | 0.48 |
| Load 8 | 1.60 | 0.60 |
| Load 9 | 0.84 | 0.75 |
| Load 10 | 0.94 | 0.42 |

As shown in Table 2, the new mat had significantly higher tensile strengths across all loads, showing, for example, a 235% mean strength increase, as compared to the commercially available mat.

The pH of Composition A was also tested at varying levels of triethanolamine addition. The pH was measured after binder formation in liquid state using a calibrated pH probe. The pH probe was soaked into the binder and a reading was taken after the pH value stabilized. These results are shown in Table 3.

TABLE 3

| TEA Addition, wt. % | Binder pH |
|---|---|
| 0.0 | 2.56 |
| 4.0 | 3.69 |
| 5.0 | 3.85 |
| 6.2 | 3.99 |
| 7.0 | 4.01 |
| 7.9 | 4.24 |
| 10.0 | 4.38 |

As shown in Table 3, the new mat exhibited significantly higher pHs (lowered acidity) as the levels of TEA increased, exhibiting, for example, a 44% increase in pH when 4.0 wt. % TEA was added as compared to the same non-woven mat without the TEA.

Although several exemplary embodiments of the present invention have been described herein, it should be appreciated that many modifications can be made without departing from the spirit and scope of the general inventive concepts. All such modifications are intended to be included within the scope of this invention and the related general inventive concepts, which are to be limited only by the following claims.

The invention claimed is:

1. A non-woven mat comprising:

a plurality of reinforcing fibers; and a binder composition comprising a binder resin, a coupling agent, and a corrosion inhibitor, wherein the binder composition is non-corrosive, wherein the binder resin comprises a thermoset material, a thermoplastic material, or a combination thereof, and wherein the non-woven mat exhibits a tensile strength of at least 1.0 lb/ft after being soaked in a 100% styrene monomer for 10 minutes;

wherein the corrosion inhibitor is triethanolamine, wherein said corrosion inhibitor is present in the binder composition from 0.05 to 15.0 wt. %, based on the total solids in the binder composition.

2. The non-woven mat of claim 1, wherein the plurality of reinforcing fibers comprises at least one of glass fibers, synthetic fibers, and natural fibers.

3. The non-woven mat of claim 1, wherein the plurality of reinforcing fibers is a mixture of chopped glass fibers and synthetic fibers.

4. The non-woven mat of claim 1, wherein the binder composition further comprises a defoamer.

5. The non-woven mat of claim 1, wherein the coupling agent comprises a silane coupling agent.

6. The non-woven mat of claim 1, wherein the thermoset material comprises at least one of an acrylic material and a urea formaldehyde material.

7. The non-woven mat of claim 1, wherein the thermoplastic material comprises ethylene vinyl acetate.

8. The non-woven mat of claim 1, wherein the binder resin comprises from 50.0 to 100 wt. % of the thermoplastic material and from 0 to 50.0 wt. % of the thermoset material, based on the total binder resin.

9. The non-woven mat of claim 1, wherein the non-woven mat does not exhibit any fiber whitening after curing, as compared to an otherwise identical non-woven mat without the corrosion inhibitor.

* * * * *